US007137933B2

(12) United States Patent
Shifferaw

(10) Patent No.: US 7,137,933 B2
(45) Date of Patent: Nov. 21, 2006

(54) APPARATUS AND METHODS FOR ABDOMINAL MUSCLE AND GLUTEAL MUSCLE EXERCISE

(76) Inventor: Tessema Dosho Shifferaw, Suite 2000, 1060 Solano Ave., Albany, CA (US) 94706-1681

( * ) Notice: Subject to any disclaimer, the term of this patent is extended or adjusted under 35 U.S.C. 154(b) by 0 days.

(21) Appl. No.: 11/018,770

(22) Filed: Dec. 20, 2004

(65) Prior Publication Data

US 2005/0143233 A1 Jun. 30, 2005

Related U.S. Application Data

(60) Provisional application No. 60/185,081, filed on Feb. 25, 2000.

(51) Int. Cl.
*A63B 21/02* (2006.01)

(52) U.S. Cl. ..... 482/121; 482/38; 482/44; 482/62

(58) Field of Classification Search ..... 482/121, 482/38, 44, 62; D12/662, 665, 682, 684
See application file for complete search history.

(56) References Cited

U.S. PATENT DOCUMENTS

| | | | |
|---|---|---|---|
| 1,215,609 | A | 2/1917 | Arnold |
| 1,821,417 | A | 9/1931 | Bounds |
| 3,497,216 | A | 2/1970 | Feather |
| 3,497,217 | A | 2/1970 | Feather |
| 3,589,715 | A | 6/1971 | Mark |
| 4,204,676 | A | 5/1980 | Givens |
| 4,287,620 | A | 9/1981 | Zur |
| 5,269,737 | A | 12/1993 | Sobotka |
| 5,295,930 | A | 3/1994 | Hogan |
| 5,352,173 | A | 10/1994 | McLaughlin |
| 5,441,473 | A | 8/1995 | Safani |
| 5,545,114 | A | 8/1996 | Gvoich |
| 5,599,261 | A | 2/1997 | Easley |
| 5,624,361 | A | 4/1997 | Lai |
| 5,806,115 | A | 9/1998 | Brown |
| 5,865,715 | A | 2/1999 | Wallick |
| 5,897,470 | A | 4/1999 | Chen |
| 5,931,769 | A | 8/1999 | Nunez |
| 5,947,876 | A | 9/1999 | Willey |

*Primary Examiner*—Lori Amerson
(74) *Attorney, Agent, or Firm*—Edward S. Wright

(57) ABSTRACT

Device and methods for strengthening and toning the abdominal and gluteal muscles. A seat is mounted in a fixed position on a base, and a back is pivotally mounted for movement about an axis toward the rear of the seat, with springs or elastic cords yieldably urging the backrest to pivot in an upward direction toward a raised position. To strengthen and condition the upper, lateral and oblique abdominal muscles and gluteal muscles, an exerciser rests upon the seat, with his back against the backrest, and the elastic cords or springs assist him in raising his back and also allow him to extend to the full range of backward motion while absorbing the impact of that motion. To exercise the lower abdominal muscles and gluteal muscles, the exerciser reclines on the seat, with his legs on the backrest and the elastic cords or springs assisting him in raising his legs and absorbing the impact of lowering them.

27 Claims, 7 Drawing Sheets

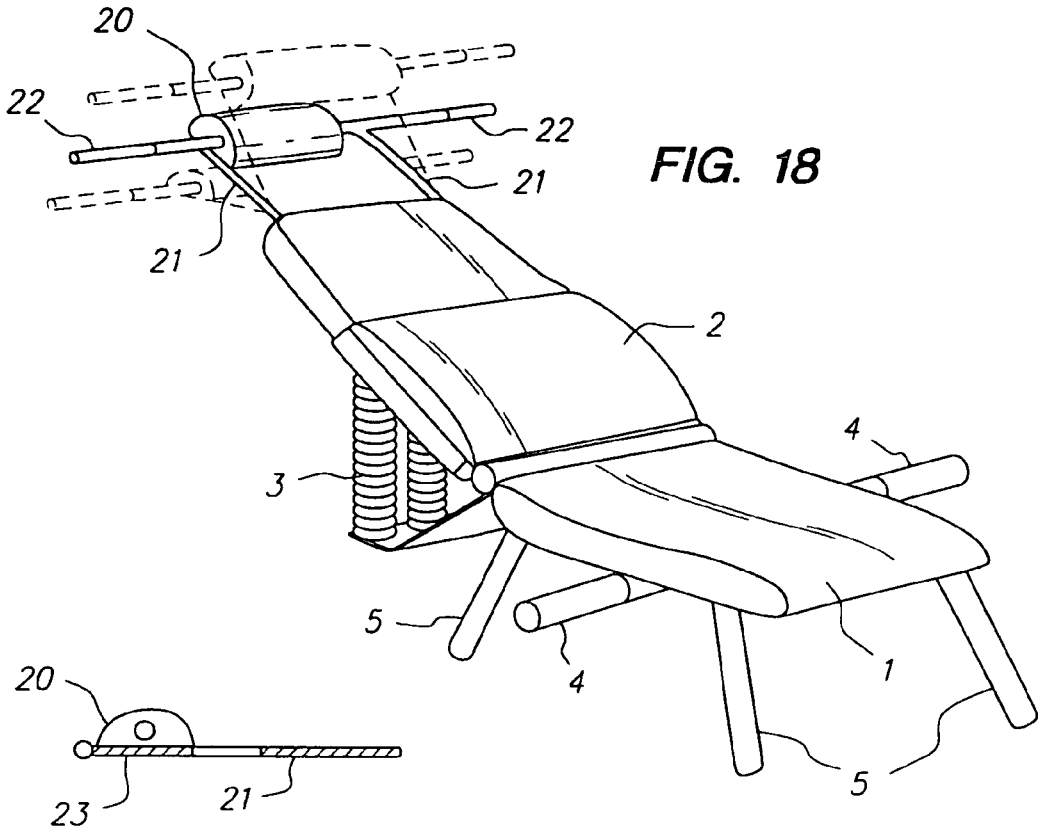
FIG. 18
FIG. 19
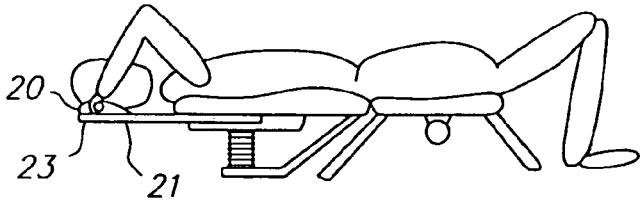
FIG. 20
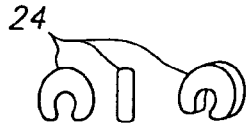
FIG. 22
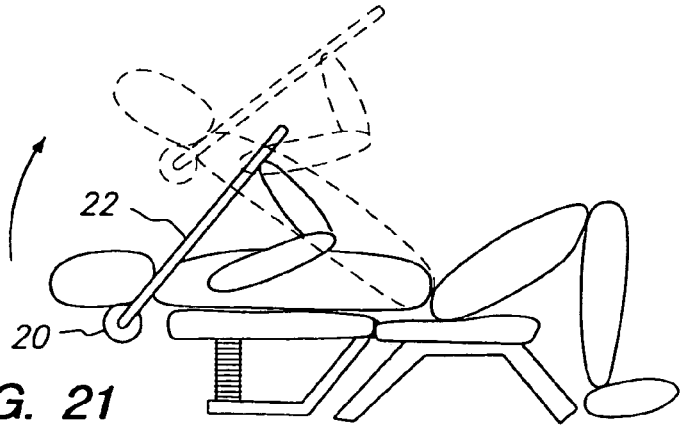
FIG. 21

FIG. 23
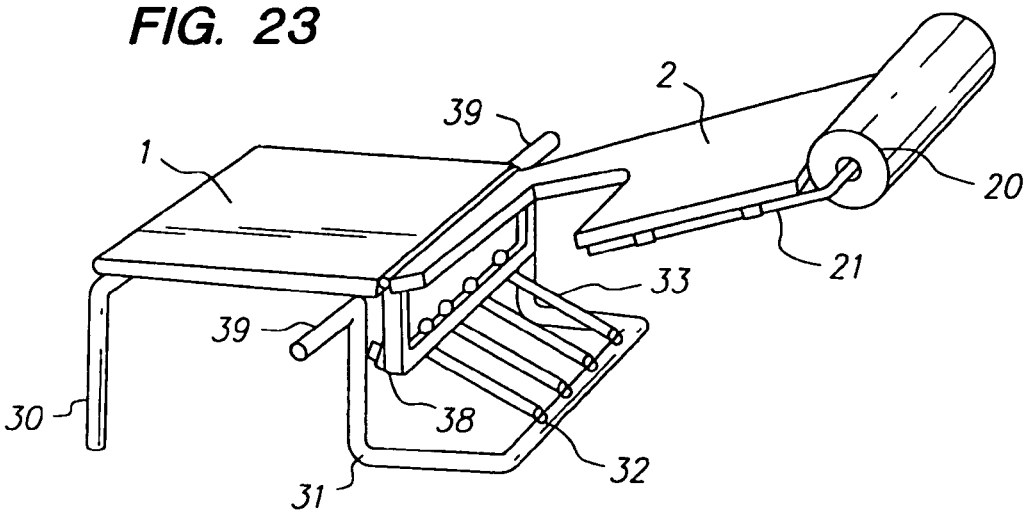
FIG. 24
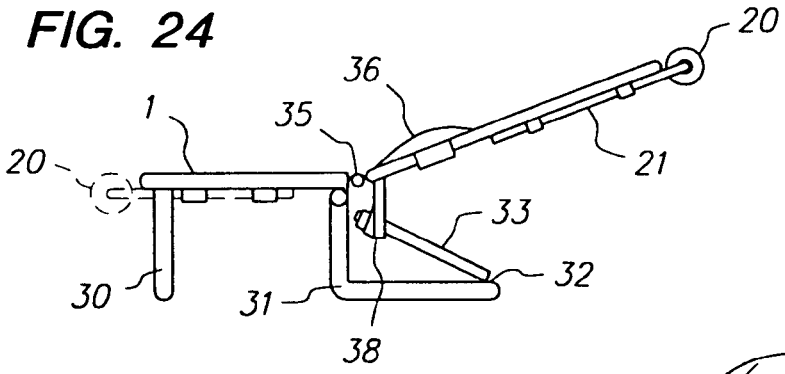
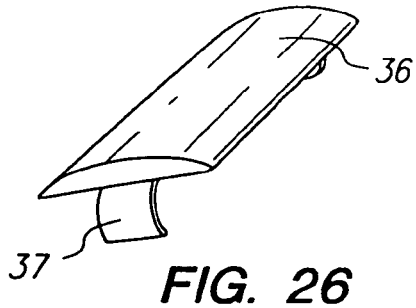
FIG. 26
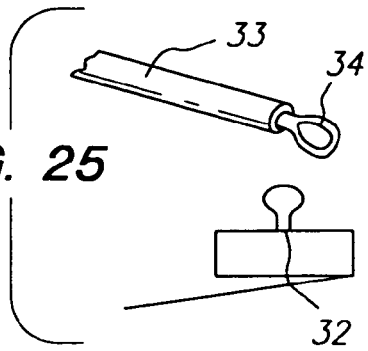
FIG. 25
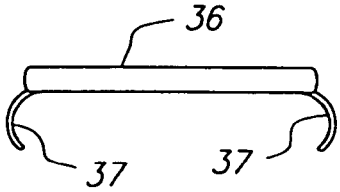
FIG. 27

APPARATUS AND METHODS FOR ABDOMINAL MUSCLE AND GLUTEAL MUSCLE EXERCISE

CROSS-REFERENCE TO RELATED APPLICATIONS

Provisional application No. 60/185,081 filed on Feb. 25, 2000, and non-provisional application Ser. No. 09/539,682 filed on Mar. 30, 2000.

STATEMENT REGARDING FEDERALLY SPONSORED RESEARCH OR DEVELOPMENT

Not applicable.

REFERENCE OF A MICROFICHE

Not applicable.

BACKGROUND OF THE INVENTION

The present invention generally relates to methods and apparatus for exercising the abdominal muscles and gluteal muscles. A variety of exercise equipment have been developed to exercise abdominal muscles and gluteal muscles. These devices range from adjustable inclined surfaces with foot stirrups for securing a user's feet in place while sit-ups are performed to equipment in which the user sits and moves forward against adjustable resistance. Another variation of this general abdominal and gluteal exercise equipment is a floor positioned curved rocker system for support of the reclined user's upper body. As the user performs regular sit-ups, the device rocks back and forth for the full range of exercise motion.

Information relevant to attempts to address these problems can be found in U.S. Pat. No. 5,441,473, issued Aug. 15, 1995, U.S. Pat. No. 5,545,114, issued Aug. 13, 1996, U.S. Pat. No. 5,897,470 issued Apr. 27, 1999, U.S. Pat. No. 5,931,769, issued Aug. 3, 1999, and U.S. Pat. No. 5,947,876, issued Sep. 7, 1999. However, each one of these references suffers from one or more of the following disadvantages: limited range of motion or breadth of exercise range; unwieldy size and lack of portability; lack of support assist to beginner exercisers; lack of impact adsorption at the full extension of exercise motion; lack of scalable adjustment to the support assist available to the exerciser, simplicity in use and instruction; lack of an aerobic exercise mode or component, lack of combination of exercise for both abdominal and gluteal muscle groups in the same apparatus, and expense.

These various drawbacks can discourage beginners or non-athletic users from participating in a conditioning and strengthening regimen for abdominal or gluteal exercise. When used without training or instruction, these apparatus can actually injure the user from strain or improper exercise motion. Many of these systems are too costly or unwieldily for home use or travel.

The most significant limitation of the prior-art devices is the failure to duplicate the range of motion necessary to condition the upper, lower, oblique or lateral abdominal muscles and the gluteus maximus muscles while assisting the novice or beginner user in offering scalable impact absorption at the full range of extension for any of the associated exercise positions. This limitation increases the likelihood of improper exercise form, injury, or discontinued use due to the lack of any tangible benefit from the exercise.

For the foregoing reasons there is need for an improved abdominal muscle and gluteal muscle exercise apparatus and methods which employ a means for impact absorption at the full extension range of abdominal exercise motion.

DISCLOSURE OF INVENTION

Apparatus and methods are provided for specifically strengthening and toning the abdominal muscles and gluteal muscles of a human exerciser. The apparatus includes a seat member and back member pivotally connected so as to allow use for a full range of abdominal and gluteal exercises when the apparatus is in the horizontally open position, and easy storage or portability when the apparatus is vertically closed.

A primary benefit of the present invention is the fact that through a connected, adjustable resilient means the back member bounces to assist the exerciser in the upward or concentric motion, offering from twenty (20%) percent to forty (40%) percent of the force necessary to rise up, while assisting in ten (10%) percent to twenty (20%) of the exertion in the downward motion. This connected, adjustable resilient means likewise serves to cushion or absorb impact of the exerciser's downward or eccentric motion, the range of motion in which the abdominal muscles and gluteal muscles need the most assistance for the exercises available using the present invention. The exerciser needs not contact the back member at all time; only during the extended positions where the eccentric motion transfers to the concentric motion. Through the connected, adjustable resilient means, the back member pushes or propels the exerciser up to the full concentric position. The exerciser then can slowly reverse movement, using the abdominal muscles and gluteal muscles to control eccentric motion to a contact point of seat member thus engaging the connected, adjustable resilient means assistance. By setting the connected, adjustable resilient means to a desired preset, the exerciser can maximize the exercise regimen, thus working the abdominal muscles and gluteal muscles longer. Aerobic and anaerobic condition can be combined in a single series of exercises, depending on the exerciser's particular level of conditioning.

The seat member ergonomically shaped to support exerciser's buttocks and upper thighs. When the exerciser reverses alignment, the seat shape serves to fit the back and support the lumbar area. In one embodiment of the present invention the seat member is solidly supported by legs which retract into the underside of the seat member when the apparatus is not in use. The seat member also provides two solid handles extending outward for the sides. These handles retract within the seat member when the apparatus is not in use.

In a second embodiment of the present invention an external frame assembly supports a seat member and a back member. Said external frame is fixedly attached to said seat member, and adjustably attached to said back member. In this second embodiment of the present invention said external frame also provide an adjustable foot rest for the exerciser.

The back member is ergonomically fitted with a backboard designed to fit the back and support the lumbar area in all exercises. This backboard can be made from foam or similar polyurethane materials. When the exerciser reverses alignment, the back member supports the exerciser's buttocks and upper thighs. To allow the exerciser to utilize the full range of motion necessary for optimal abdominal and gluteal exercise, the back member houses an adjustable resilient means which opposes force applied to the seat back.

The adjustable resilient means is retractable into the back member when the apparatus is not in use.

In one method of operation, an exerciser sits on the seat member with the exerciser's back against the back member. With hands on the seat handles, the exerciser performs a variety of abdominal and gluteal exercises by pushing back on the back member to the point of full extension, whereby the adjustable resilient means assists the exerciser in returning to the starting position of the exercise. This cycle is repeated for several repetitions depending on the exerciser's level of conditioning or the adjustment of the resilient means. During this operation, the exerciser may elect to keep the feet on the floor with the knees bent and raised above the torso, or the feet can be raised with the knees bent or straight, depending on the conditioning level of the user.

In a second method of operation, an exerciser sits on the back member with the exerciser's back against the seat members. By locking the arms under the seat handles, the exerciser performs a variety of abdominal and gluteal exercises by pushing down on the back member with the legs at full lowered position, whereby the adjustable resilient means assists the exerciser in raising the legs to the starting position of the exercise. This cycle is repeated for several repetitions depending on the exerciser's level of conditioning or the adjustment of the adjustable resilient means.

The present invention thus provides an exerciser with a full complement of exercises for all abdominal and gluteal areas. The apparatus is relatively inexpensive and it is lightweight for easy storage or portability when the apparatus is not in use. The resilient impact absorption provides the exerciser a scalable assistance at the full range of extension in the exercises, so as to minimize improper form or injury.

It is therefore an object of the present invention to provide a new exercise device apparatus and methods which have many of the advantages of the exercise devices mentioned heretofore and many novel features that result in a new exercise device which is not anticipated, rendered obvious, suggested, or even implied by any of the prior art exercise devises, either alone or in any combination thereof.

It is another object of the present invention to provide a new exercise device which may be easily and efficiently manufactured and marketed.

It is a further object of the present invention to provide a new exercise device which is of a durable and reliable construction.

An even further object of the present invention is to provide a new exercise device which is susceptible of low cost of manufacture with regard to both materials and labor, and which accordingly is then susceptible of low prices of sale to the consuming public, thereby making such exercise device economically available to the buying public.

Still yet another object of the present invention is to provide a new exercise device for exercising both the abdominal and gluteal muscles of a user.

These together with other objects of the invention, along with the various features of novelty which characterize the invention, are described with particularity in the claims attached to and forming a part of this disclosure. For a better understanding of the invention, its operating advantages and the specific objects attained by its uses, reference should be made to the attached drawings and descriptive materials in which there are illustrated preferred embodiments of the invention.

BRIEF DESCRIPTION OF THE DRAWINGS

FIG. 18 is an isometric view of an embodiment of the abdominal and gluteal muscle exercising device of the present invention showing the fully adjustable and flexible neck rest.

FIG. 19 is a side view of the neck rest assembly.

FIG. 20 is a side view of an embodiment of the abdominal and gluteal muscle exercising device of the present invention showing an exerciser engaging one embodiment of the neck rest assembly.

FIG. 21 is a side view of a presently preferred embodiment showing the range of motion of an exerciser engaging a second embodiment of the neck rest assembly.

FIG. 22 are front, side, and isometric views of weights to be used with the second embodiment of the neck rest assembly.

FIG. 23 is an isometric view of another embodiment of the abdominal and gluteal muscle exercising device of the present invention with a portion of the back rest cut away to depict the plurality of shock bungies which provide the resilient means to support and resist the desired ranges of motion.

FIG. 24 is a side view of the embodiment of the abdominal and gluteal muscle exercising device of the present invention depicted in FIG. 23 with lumbar support pad attached and in support position.

FIG. 25 is a detailed view of a shock bungie end and the attaching post for either the seat frame support or the back rest.

FIG. 26 is an isometric view of the lumbar support pad.

FIG. 27 is a front view of the lumbar support pad.

DETAILED DESCRIPTION

FIGS. 1–4 show a presently preferred embodiment of the abdominal muscle exercise apparatus invention consisting essentially of a seat member 1 connected by a pivot 8 to a back member 2 which together support the exerciser in a range of exercise positions initiated from a supine position on the apparatus as more generally indicated by FIGS. 13–17.

Figure 5:
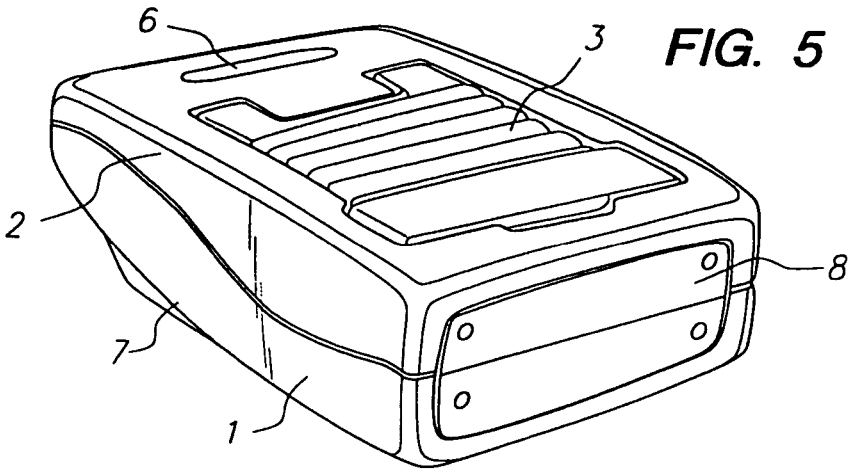
FIG. 5 is an isometric view of a third embodiment of the abdominal and gluteal muscle exercising device of the present invention folded closed with adjustable resilient means retracted for transport or storage.
Figure 6:
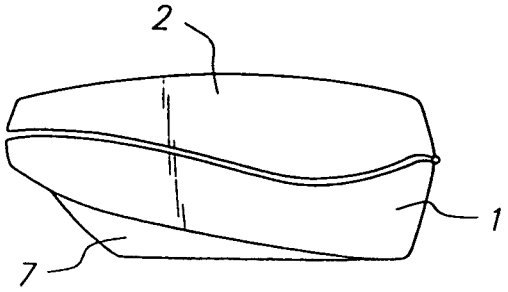
FIG. 6 is a side view of a third embodiment of the abdominal and gluteal muscle exercising device of the present invention folded closed with adjustable resilient means retracted for transport or storage.
Figure 7:
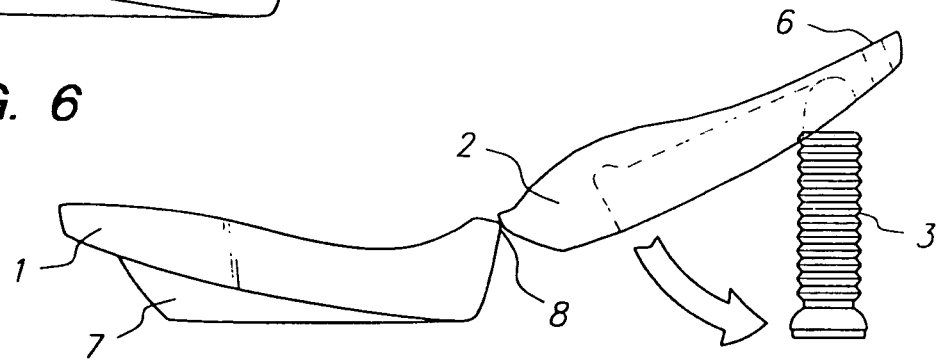
FIG. 7 is a side view of a third embodiment of the abdominal and gluteal muscle exercising device of the present invention with adjustable resilient means fully extended for use.

The seat member 1 bottom side contains retractable front and back support legs 5 and retractable seat handles 4. In a third presently preferred embodiment, the bottom side of the seat member is constructed of a unitary horizontal support structure 7 as depicted in FIGS. 5–7.

The seat member 1 top side can be ergonomically fitted to receive the exerciser's buttocks and upper thighs as depicted in FIGS. 2 and 3, and 13–15.

Figure 1:
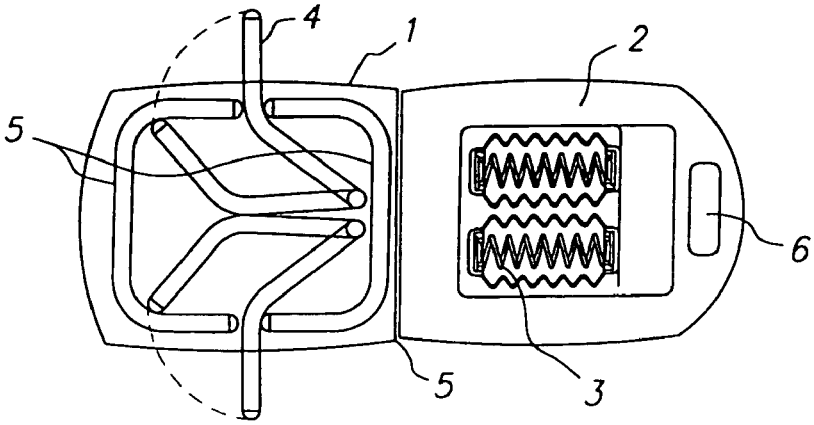
FIG. 1 is a bottom view of an embodiment of the abdominal muscle exercising device of the present invention indicating the retractable legs and handle in the seat member and the retractable, adjustable resilient means in the back member.
Figure 2:
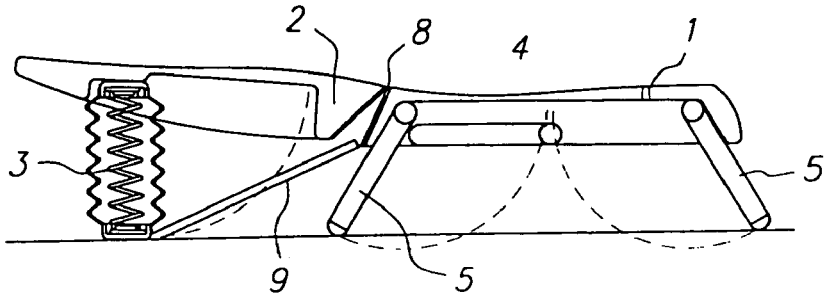
FIG. 2 is a side view of an embodiment of the abdominal and gluteal muscle exercising device of the present invention with adjustable resilient means, seat handles, and supporting legs fully extended for use.
Figure 3:
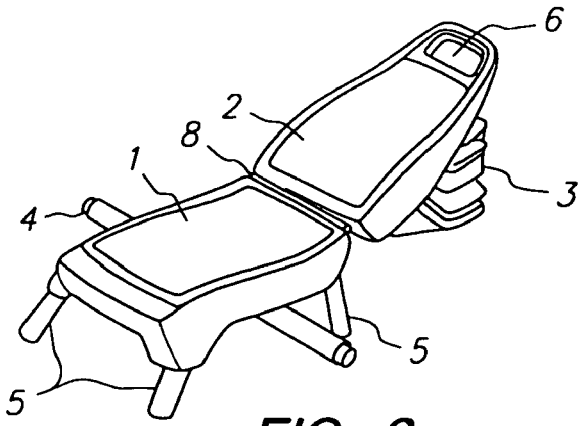
FIG. 3 is an isometric view of an embodiment of the abdominal and gluteal muscle exercising device of the present invention with adjustable resilient means, seat handles, and supporting legs fully extended for use.
Figure 4:
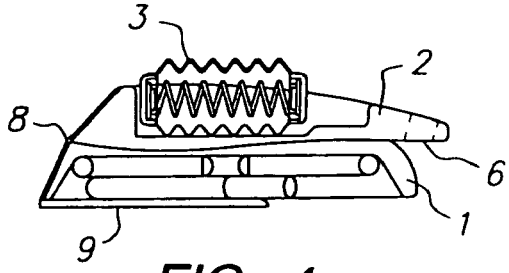
FIG. 4 is a side view of an embodiment of the abdominal and gluteal muscle exercising device of the present invention folded closed with adjustable resilient means, seat handle, and support legs retracted for transport or storage.
Figure 10:
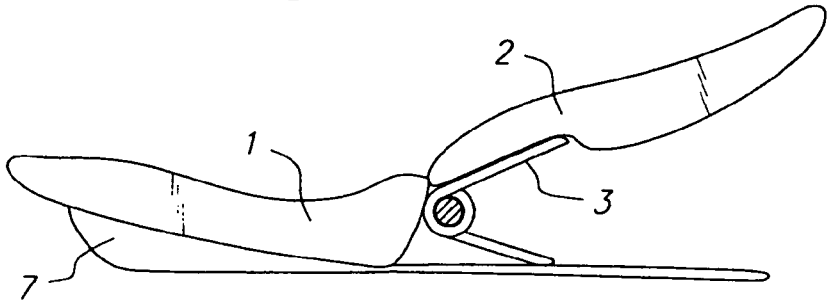
FIG. 10 is a side view of a second embodiment of the abdominal and gluteal muscle exercising device of the present invention with compression spring adjustable resilient means fully extended for use.
Figure 11:
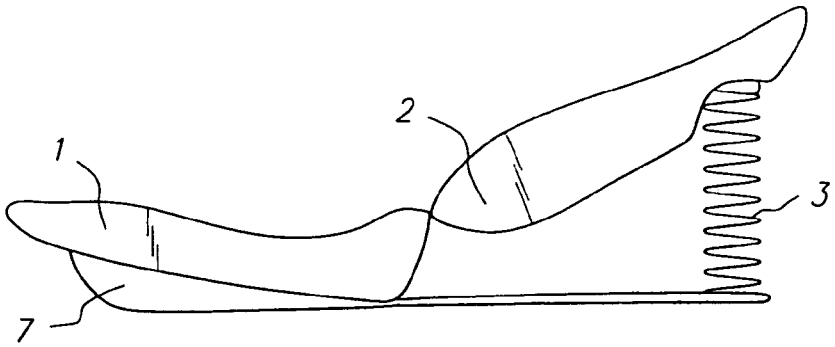
FIG. 11 is a side view of a second embodiment of the abdominal and gluteal muscle exercising device of the present invention with torsion spring adjustable resilient means fully extended for use.
Figure 12:
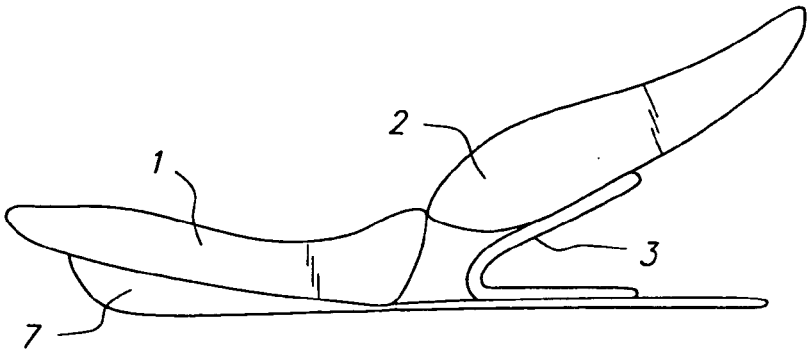
FIG. 12 is a side view of a second embodiment of the abdominal and gluteal muscle exercising device of the present invention with "C" shaped spring adjustable resilient means fully extended for use.
Figure 13:
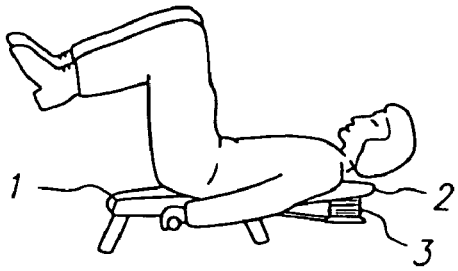
FIG. 13 is a side view of an embodiment of the abdominal and gluteal muscle exercising device of the present invention wherein the exerciser is sitting on the seat, hands on the seat handles, legs bent above the torso, and feet off the ground.
Figure 14:
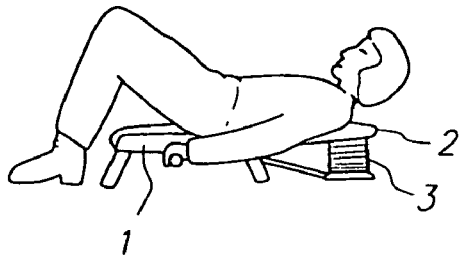
FIG. 14 is a side view of an embodiment of the abdominal and gluteal muscle exercising device of the present invention wherein the exerciser is sitting on the seat, hands on the seat handles, legs bent above the torso, and feet on the ground.
Figure 15:
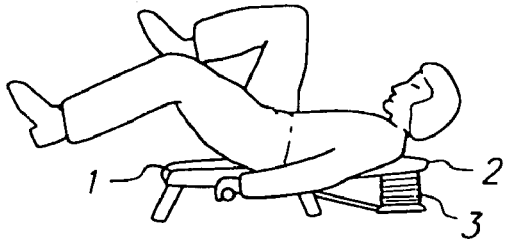
FIG. 15 is a side view of an embodiment of the abdominal and gluteal muscle exercising device of the present invention wherein the exerciser is sitting on the seat, hands on the seat handles, legs bent above the torso, and feet off the ground and rotating in a bicycling motion.
Figure 16:
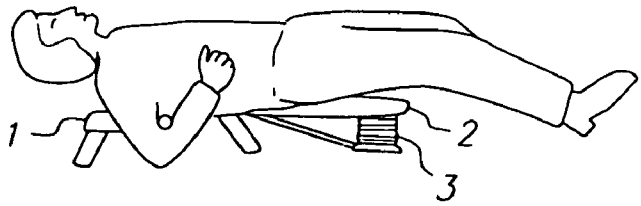
FIG. 16 is a side view of an embodiment of the abdominal and gluteal muscle exercising device of the present invention wherein the exerciser is sitting on the back member, arms locked under the seat handles, legs extended together outward along the back member.

The back member 2 bottom side contains a retractable, adjustable resilient means 3 wherein a force applied against the back member 2 in a direction opposite the back member 2 is opposed by said adjustable resilient means 3. The adjustable resilient means 3 of the embodiment shown in FIGS. 1–4, and 11 comprises at least one compression spring which is held in operable position by a stabilizing arm 9 as depicted in FIG. 2. The position of the resilient means 3 can be varied depending on the desired level of force from said means. The stabilizing arm 9 is pivotally attached to said seat member 1 bottom side and folds flat against said seat member 1 bottom side when the apparatus is not in use as depicted in FIG. 4. Other embodiments of said adjustable resilient means 3 comprises at least one torsion spring, FIG. 10, or at least one "C" spring, FIG. 12. Other possible adjustable resilient means include hydraulics, pneumatics, and the like. As shown in another embodiment of the present invention as depicted in FIGS. 23, 24, 28, and 29 the resilient means is provided by a plurality of shock bungies 33 attached at one end to the bottom underside of the backrest 2 and at the other end 34 to the seat support legs 32. In this assembled embodiment, the resilient means is varied by increasing or decreasing the number of shock bungies 33 attached, depending on the level of resistence desired by the exerciser. This variation is accomplished by detaching or attaching the desired number of bungies 33 from the seat support legs 32 as depicted in FIGS. 23–25. The use of shock bungies as the resilient means is equally applicable across all embodiments of the present invention using the assembly depicted in FIGS. 23–25 and connecting said shock bungies between the back member 2 and the back support legs 5 or the seat member 1.

In one embodiment of the present invention, the end of the back member 2 opposite the pivot 8 to the seat member 1 supplies a handle 6 for ease in transporting or storing the apparatus when not in use. As depicted in FIGS. 4–6, said handle may be unitarily constructed into said seat member 1. In other embodiments of the present invention, the back member 2 houses an fully adjustable and flexible neck rest as detailed in FIGS. 18–20, 23–24, and 28–29. The fully adjustable and flexible neck rest telescopes from within side housings in each side of the back member 2 on two telescoping rods 21. The telescoping rods 21 provide a frame support assembly 23 for a padded support 20 for the exerciser's neck and for two telescoping neck rest handles 22. The neck rest handles are secured at their bases withing a housing contained on the bottom centerline of the padded support 20. Use of the fully adjustable and flexible neck rest is optional, and it can be employed within particular exercise regimens designed to the exerciser's preference. The telescoping rods 21 and the telescoping neck rest handles 22 can be constructed from a broad range of materials suitable for strength, flexibility, and resilience. The preferred material for the telescoping rods 21 is nylon. The preferred material for the telescoping neck rest handles 22 is nylon. When not in use, the telescoping neck rest handles 22 are withdrawn into the padded support 20.

Another embodiment of the present invention using the telescoping neck rest is depicted in FIG. 21. When withdrawn from the back rest 2 the telescoping rods 21 extend forward in a fixed position to allow the user to place their hands on said handles 21 palms inward with the arms bent at approximately ninety degree angles. In this manner, the exerciser can assist in the concentric motion as well as add additional resistance in the form of weights 24 depicted in FIG. 22 to the frame support assembly 23.

The back member 2 top side is ergonomically constructed to support the exerciser's lumbar region. In another embodiment of the present invention, FIGS. 24 and 26–27, a removable lumbar support pad 36 is provided to add further lower back support for the exerciser. The removable lumbar back support pad 36 has resilient clips 37 on either ends as depicted in FIGS. 26–27 to readily clasp and attached to the back rest (2) or the seat support 1, or easily be removed therefrom.

Figure 8:
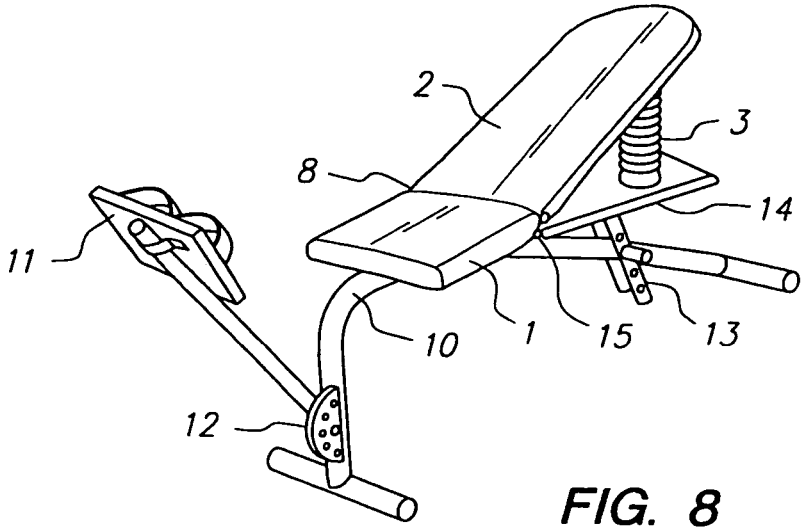
FIG. 8 is an isometric view of a second embodiment of the abdominal and gluteal muscle exercising device of the present invention with external support frame, adjustable foot rest, adjustable resilient means, and adjustable back member position.
Figure 9:
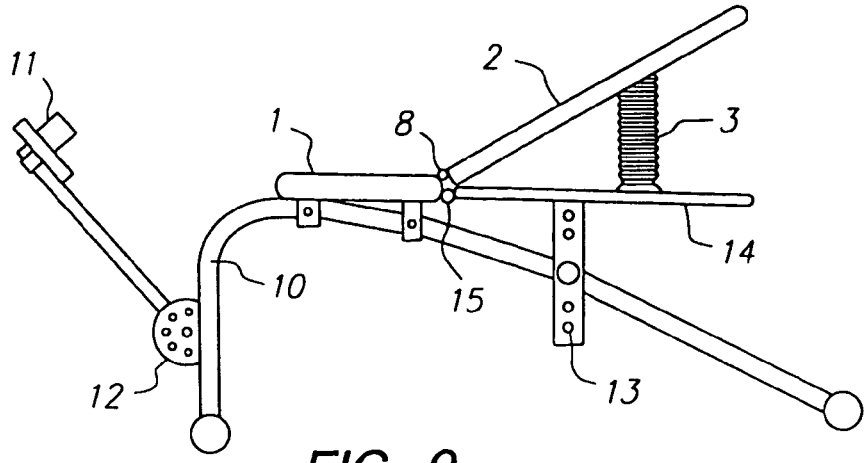
FIG. 9 is a side view of a second embodiment of the abdominal and gluteal muscle exercising device of the present invention folded with external support frame, adjustable foot rest, adjustable resilient means, and adjustable back member position.

In another embodiment of the present invention as depicted in FIGS. 8–9, a seat member 1, a pivotally connected back support member 2, and a pivotally connected frame mount back member 14 are supported by an external frame assembly 10. Said frame assembly 10 provides the exerciser with a foot restraint 11 and a pivotal attachment 12 to angularly adjust said foot restraint 11 to the frame assembly 10. Said frame assembly 10 provides a pivot 13 to angularly adjust said frame mount back member 14. Said frame mount back member 14 is pivotally connected to said seat member, and operates independently of the pivotally connected back support member 2. As with the other embodiments of the present invention, the second preferred embodiment of the present invention absorbs the impact of the exerciser's eccentric exercise motion by said adjustable resilient means 3; the exerciser's concentric exercise motion is supported by said adjustable resilient means 3. The location of said resilient means is adjustable along the frame mount back member 14 and the back support member 2. In addition, the degree of the resilient means 3 is variable by adding or decreasing resilient means 3 components to the apparatus.

In one embodiment of the abdominal muscle exercise apparatus invention the pivot 8 between the seat member 1 and back member 2 is a recessed polypropylene hinge, or similar device, affixed to the adjacent ends of the seat member 1 and back member 2 as depicted in FIGS. 1–5, and 7. In the second preferred embodiment of the abdominal muscle exercise apparatus invention depicted in FIG. 9 the pivot 8 between the seat member 1 and back support member 2 and the pivot 15 between the seat member 1 and frame mount back member 14 are piano hinges, or similar devices, affixed to the adjacent ends of the seat member 1 and back support member 2, and the seat member 1 and frame mount back member 14, respectively. This embodiment of the present device offers maximum support for the exerciser's hips and back through the full range of abdominal muscle and gluteal muscle exercises.

Figure 28:
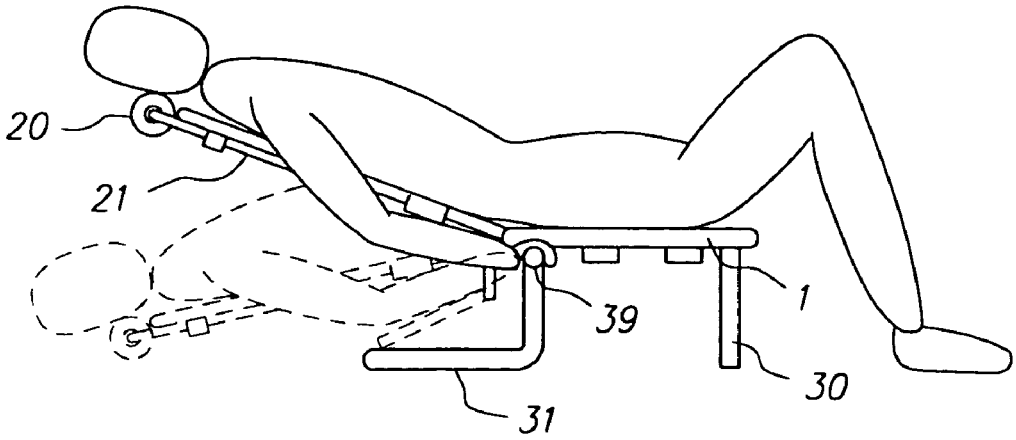
FIG. 28 is a side view of the embodiment of FIG. 23. with an exerciser doing an abdominal exercise.
Figure 29:
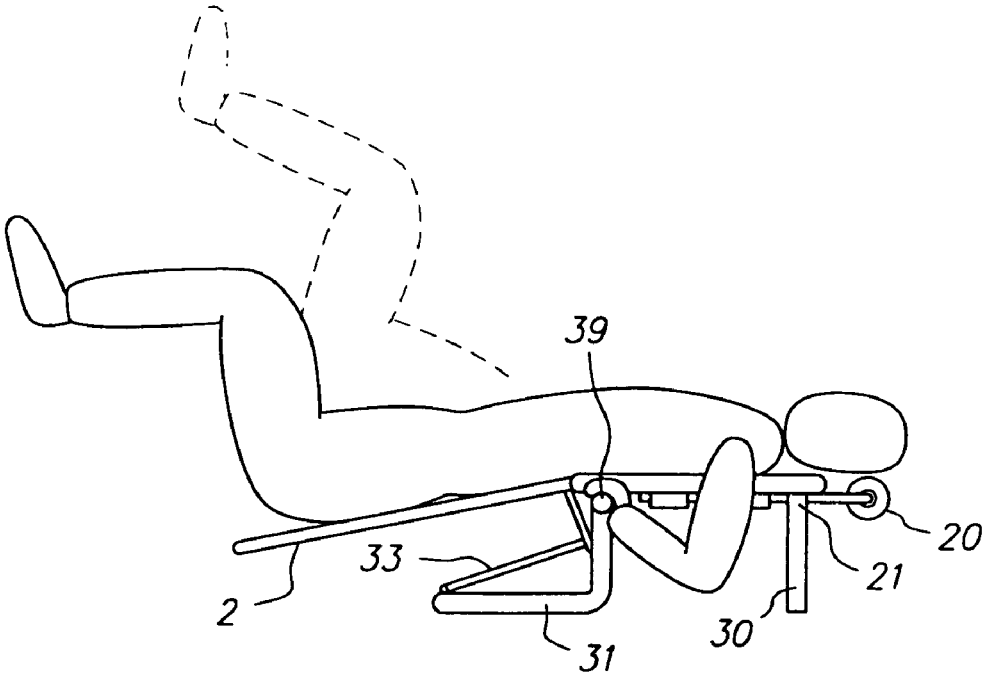
FIG. 29 is a side view of the embodiment of FIG. 23. with an exerciser doing a leg raising exercise.

In the presently preferred embodiment of the present invention, FIGS. 23–24 and 28–29, the seat member 1 is supported by fixed support legs 30 and 31. The seat member further comprises internal channels to receive the telescoping rods 21 and padded support 20 as depicted in FIG. 29. The seat member 1 is connected to the back member 2 by a pivot 35. The back member also comprises internal channels to receive the telescoping rods 21 and padded support 20 as depicted by FIGS. 23–24 and 28. The pivot end underside of the back member 2 comprises a frame 38 to attach a plurality of shock bungies 33 which provide the resilient means for the support and resistence for a full range of desired exercises using the present invention. These shock bungies 33 are attached at the other end to the foot of the seat support frame assembly 31 at attaching pegs 32. A detachable and adjustable lumbar support assembly FIGS. 26 and 27 provides a lumbar support pad 36 and resilient clips 37 which affix the lumbar support pad 36 to the back rest 2 in a variety of adjustable positions, one of which is depicted in FIG. 24. Seat support frame assembly 31 further provides handles 39 on either side of the seat support to assist the exerciser in performing various exercise regimens as depicted in FIGS. 28 and 29.

The operation of various embodiments of the abdominal muscle and gluteal muscle exercise apparatus invention wherein the exerciser elects to strengthen and condition the upper, lateral and oblique abdominal muscles and gluteal muscles is depicted in FIGS. 13–15, 20–21, and 28. In this method of operation, the exerciser sits in the seat member 1 and reclines the back against the back member 2 with the legs bent and feet off the ground, FIG. 13, on the ground, FIGS. 14 and 28, or rotated in a bicycling motion, FIG. 15. The adjustable resilient means 3 in the back member 2 helps the exerciser extend to the full range of backward motion while absorbing impact of the backward motion. The impact of the exerciser's eccentric exercise motion is adsorbed by said adjustable resilient means; the exerciser's concentric exercise motion is supported by said adjustable resilient means. If desired, the exerciser may adjust the fully adjustable and flexible neck rest to further assist in the eccentric and concentric ranges of motion described in this method. The neck rest is first extended from the back member 2 by adjusting the flexible nylon rods 21 to the desired position under the exerciser's neck as depicted in FIGS. 20, 28 and 29. The exerciser then positions their hands on either side of their head on the telescoping handles 22 to further assist in the range of motion during exercise. In other embodiments, the exerciser grasps the handles 39 on either side of the seat support 1 to further assist in the range of motion during exercise as depicted in FIGS. 28 and 29.

Figure 17:
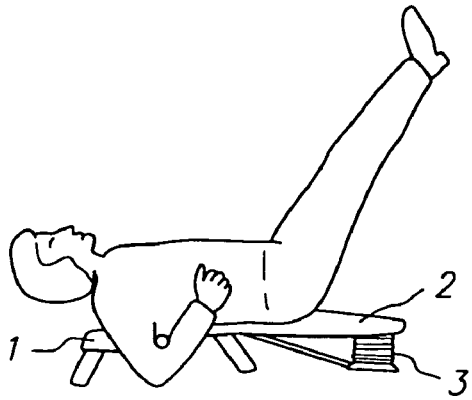
FIG. 17 is a side view of an embodiment of the abdominal and gluteal muscle exercising device of the present invention wherein the exerciser is sitting on the back member, arms locked under the seat handles, legs extended together above the torso.

The operation of various embodiments of the abdominal muscle and gluteal muscle exercise apparatus invention wherein the exerciser elects to strengthen and condition the lower abdominal muscles and gluteal muscles is depicted in FIGS. 17–18 and 29. In this method of operation, the exerciser sits in the back member 2 and reclines the back against the seat member 1 with the legs extended and feet off the ground, FIGS. 17 and 29, or raised together, FIG. 18. The adjustable resilient means 3 in the back member 2 assists in the exerciser's concentric motion to extend to the full range of extended raising leg motion FIGS. 17 and 29 while absorbing impact of the exerciser's eccentric lowering leg motion FIG. 16.

With respect to the above description then, it is to be realized that the optimum dimensional relationships for the components of the invention, to include variations in size, materials, shape, form, function and manner of operation, assembly, manufacture, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Additionally, since numerous modifications and changes will readily occur to those skilled in the art, it is not desired to limit the invention to the exact construction and operation shown and described, and further, all suitable modifications and equivalents may be resorted to, falling within the scope of the invention.

I claim:

1. An exercise machine, comprising a base having a rear cross member, a horizontally extending seat mounted in a stationary position on the base, a back support pivotally mounted on the base in front of the cross member for movement between raised and lowered positions, and a plurality of resilient elements connected between the back support and the cross member for yieldably lifting the back support toward the raised position.

2. The exercise machine of claim 1 wherein the back support is pivotally connected to the seat.

3. The exercise machine of claim 1 wherein the resilient elements are elastic cords.

4. The exercise machine of claim 1 wherein the base includes a pair of laterally extending handles which are adapted to be gripped by a person using the machine.

5. The exercise machine of claim 1 further including a headrest mounted on the back support for adjustment between extended and retracted positions.

6. The exercise machine of claim 1 further including a support attached to a rod for movement between extended and retracted positions in front of the seat.

7. The exercise machine of claim 1 further including a lumbar support which is removably mounted on the back support.

8. An exercise machine, comprising a base having a cross-member, a seat mounted on the base in a stationary position in front of the cross-member. a backrest having a downwardly extending frame toward one end thereof mounted for pivotal movement about an axis near the rear of the seat, and a plurality of resilient elements connected between the frame and the cross-member for yieldably urging the backrest to pivot in an upward direction.

9. The exercise machine of claim 8 wherein the resilient elements are elastic cords.

10. The exercise machine of claim 8 wherein the base includes a pair of laterally extending handles which are adapted to be gripped by a person using the machine.

11. The exercise machine of claim 8 further including a headrest which is mounted on the backrest for adjustment between extended and retracted positions.

12. The exercise machine of claim 8 further including a support attached to a rod for movement between extended and retracted positions in front of the seat.

13. The exercise machine of claim 8 further including a lumbar support which is removably mounted on the backrest.

14. The exercise machine of claim 8 wherein the backsupport is pivotally connected to the seat.

15. The exercise machine of claim 8 wherein the resilient elements are partially wrapped about and extend beneath the frame of the backrest.

16. An abdominal exercise machine, comprising; a frame, a seat mounted in a stationary position on the frame, a backrest pivotally connected to the seat, a backrest support pivotally connected to the seat and extending beneath the backrest, means connected between the backrest support and the frame for holding the backrest support in different angular positions relative to the seat, and means yieldably urging the backrest away from the backrest support.

17. The exercise machine of claim 16 wherein the means urging the backrest away from the backrest support comprises a compression spring positioned between the backrest and the support.

18. The exercise machine of claim 16 further including a foot rest connected to the frame for receiving the feet of a person using the machine.

19. The exercise machine of claim 18 wherein the foot rest is pivotelly connected to the frame for holding the feet in different positions.

20. An exercise machine, comprising a base having a cross-member, a seat mounted on the base in a stationary position in front of the cross-member, a backrest mounted for pivotal movement about an axis near the rear of the seat, a frame extending downwardly from the backrest and laterally of the base in a direction generally parallel to the cross-member, and a plurality of resilient elements connected between the frame and the cross-member for yieldably urging the backrest to pivot in an upward direction.

21. The exercise machine of claim 20 wherein the frame includes a cross rail which is spaced from and generally parallel to the backrest, and resilient elements are connected between the cross rail and the cross member.

22. The exercise machine of claim 21 wherein the resilient elements are partially wrapped about and extend beneath the cross rail.

23. The exercise machine of claim 20 wherein the resilient elements are elastic cords.

24. The exercise machine of claim 8 wherein the base includes a pair of laterally extending handles which are adapted to be gripped by a person using the machine.

25. The exercise machine of claim 20 further including a headrest which is mounted on the backrest for adjustment between extended and retracted positions.

26. The exercise machine of claim 20 further including a support attached to a rod for movement between extended and retracted positions in front of the seat.

27. The exercise machine of claim 20 further including a lumbar support which is removably mounted on the backrest.

* * * * *